US006499965B2

(12) United States Patent
Cook et al.

(10) Patent No.: US 6,499,965 B2
(45) Date of Patent: Dec. 31, 2002

(54) AIR COMPRESSOR SYSTEM AND AN AIR/OIL CAST SEPARATOR TANK FOR THE SAME

(75) Inventors: Roger Cook, Warrington (GB); Jason J. Link, Huntersville, NC (US); Elizabeth B. Warner, Huntersville, NC (US); Norman Philip Lowe, Wigan (GB); James R. Dickey, Cornelius, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/776,572

(22) Filed: Feb. 2, 2001

(65) Prior Publication Data

US 2002/0106287 A1 Aug. 8, 2002

(51) Int. Cl.[7] ..... F04B 53/00
(52) U.S. Cl. ..... 417/313; 210/512.1; 418/DIG. 1
(58) Field of Search ..... 210/512.1; 417/313; 418/DIG. 1

(56) References Cited

U.S. PATENT DOCUMENTS

| | | | | |
|---|---|---|---|---|
| 460,061 A | | 9/1891 | Pratsch | |
| 735,954 A | | 8/1903 | Derby | |
| 1,390,096 A | | 9/1921 | Di Sante | |
| 1,548,420 A | | 8/1925 | Leonard et al. | |
| 1,664,333 A | | 9/1928 | Taylor | |
| 1,737,680 A | | 12/1929 | Pinkham | |
| 1,766,666 A | | 6/1930 | Meyer | |
| 1,877,888 A | | 9/1932 | Reichert et al. | |
| 1,917,606 A | * | 7/1933 | Sillers | 96/171 |
| 1,925,491 A | | 9/1933 | Lorraine | |
| 2,187,646 A | | 1/1940 | Darrieus | |
| 2,259,140 A | | 10/1941 | Rosenthal et al. | |
| 3,291,385 A | | 12/1966 | Williams et al. | |
| 3,318,074 A | | 5/1967 | Keller, Sr. | |
| 3,349,548 A | | 10/1967 | Boyen | |
| 3,413,776 A | * | 12/1968 | Vytlacil | 210/512.1 |
| 3,501,014 A | | 3/1970 | Fitch, Jr. et al. | |
| 3,877,904 A | | 4/1975 | Lowrie | |
| 4,840,732 A | | 6/1989 | Rawlins | |
| 5,123,939 A | | 6/1992 | Morin et al. | |
| 5,207,920 A | * | 5/1993 | Jones | 209/164 |
| 5,228,890 A | | 7/1993 | Soderland et al. | |
| 5,643,470 A | * | 7/1997 | Amini | 209/725 |
| 5,676,717 A | * | 10/1997 | Cope et al. | 55/321 |
| 5,746,791 A | | 5/1998 | Wang | |
| 5,772,408 A | * | 6/1998 | Hada et al. | 417/313 |
| 5,795,136 A | * | 8/1998 | Olsaker et al. | 184/6.16 |
| 6,019,826 A | | 2/2000 | Pietrobon | |
| 6,074,177 A | | 6/2000 | Kobayashi et al. | |

* cited by examiner

*Primary Examiner*—Charles G. Freay
*Assistant Examiner*—Emmanuel Sayoc
(74) *Attorney, Agent, or Firm*—Michael Best & Friedrich LLP

(57) ABSTRACT

An air compressor system having a cast separator tank for use with an oil-flooded air compressor. The cast separator tank including an integrally cast air-end inlet opening which is mountable in face-to-face engagement with an air-end discharge opening of the compressor; an integrally cast first channel which extends between the air-end inlet opening and a separation chamber; an integrally cast second channel which communicates with a lower portion of the separation chamber and which extends along an outer portion of the cast separator tank; and an integrally cast lip which extends around an inner wall of the separation chamber. The integrally cast air-end inlet opening which is mounted to the discharge opening of the compressor, serves as a mounting foot, and supports the compressor on its discharge end. The compressor system further having a motor, such that the compressor, the motor and the cast separator tank are attached to from a single unit for ease of handling. The compressor system also has a plurality of mounting feet for attachment to an appropriate sub-base.

7 Claims, 5 Drawing Sheets

AIR COMPRESSOR SYSTEM AND AN AIR/OIL CAST SEPARATOR TANK FOR THE SAME

FIELD OF THE INVENTION

The present invention relates generally to an air compressor system and more particularly to an air/oil separator tank for use with an oil-flooded air compressor.

BACKGROUND OF THE INVENTION

In conventional air compressor systems which utilize an oil-flooded compressor, air is compressed in a compression chamber or airend by a set of rotary screws, and a lubricant, such as oil, is injected into the compression chamber and mixes with the compressed air. The oil is generally injected into the compression chamber for a number of reasons including cooling the air compressor system, lubricating bearings, balancing axial forces and sealing the rotary screws. Although using oil is essential for operating these types of air compressor systems, the oil must be removed from the stream of compressed air before the compressed air may be used downstream for pneumatic equipment and/or other tools.

Thus, in such conventional air compressor systems, the compressed air and oil mixture discharged from the airend of the compressor flows with a high velocity into a separator tank where the air and oil of the air/oil mixture are caused to separate. The separator tank is usually cylindrical and the air/oil mixture is directed around an inner wall of a separation chamber. The combination of the centrifugal forces acting on the air/oil mixture and contact between the air/oil mixture and the inner wall of the separation chamber causes much of the oil to separate from the air/oil mixture, thereby allowing gravity to draw the oil downwardly into a lower portion of the separation chamber and also allowing the air to separate from the oil and flow upwardly in the separation chamber. This type of separation effect is known in the art as primary separation.

As generally known, an air/oil separator tank for an oil-flooded air compressor system generally provides two functions. The separator tank provides a means to separate oil from the air/oil mixture introduced into the separation chamber as described above and it also functions as an oil sump for the compressor system.

SUMMARY OF THE INVENTION

Conventional air compressor systems as described above include multiple hoses, tubes, pipes or the like and associated fittings connecting a compressor to a separator tank. Hoses and associated fittings provide potential leak paths which, if developed, could adversely affect the overall operation of the compressor system. Using hoses and associated fittings also requires additional assembly time. Thus, there is a need for an air compressor system which eliminates or at least reduces the number of hoses and associated fittings used to connect a compressor to a separator tank.

As commonly understood, conventional air compressor systems as described above include a motor or drivetrain to operate the compressor. Since conventional air compressor systems use a hose, typically a flexible hose, to connect the compressor to a separator tank, the drivetrain, the compressor and the separator tank are not securely attached as a single unit, thereby making it virtually impossible to maneuver the entire compressor system as one. In addition, since the compressor and the separator tank are individual units, each is provided with its own isolation or supporting mounts, thereby adding undesirable cost to the overall compressor system. Thus, there is a need for an air compressor system which is easier to handle and which is assembled together in such a way that the entire compressor system can be handled or moved as a single unit, and which is also mountable to an associated subbase, so as to provide a more cost effective compressor system.

Conventional air compressor systems as described above may include a baffle element strategically placed within a separation chamber of a separation tank to inhibit the migration of oil separated from the air/oil mixture introduced into the separation chamber from undesirably migrating upwardly into an upper portion of the separation chamber. However, such a baffle element adds to the overall cost of the compressor system and increases the assembly time associated with the compressor system. Thus, there is a need for an air compressor system which does not require the use of a baffle element and which still inhibits the migration of oil separated from the air/oil mixture introduced into the separation chamber from undesirably migrating upwardly into the upper portion of the separation chamber.

The present invention provides in one aspect thereof, a cast separator tank having an airend inlet opening which is directly mountable to an airend discharge opening of a compressor. The construction of the invention eliminates any need for a hose and associated fittings to connect the airend discharge opening of the compressor to the airend inlet opening of the separator tank.

The present invention provides in another aspect thereof, a cast separator tank having an integrally cast channel extending between an airend inlet opening and a separation chamber. An air/oil mixture discharged from a compressor enters the airend inlet opening and flows through the channel into the separation chamber. The integrally cast channel further eliminates the need for associated hoses and fittings between the compressor and the separator tank.

In one embodiment, a cast separator tank includes an integrally cast member which surrounds the airend inlet opening and which is positioned beneath the airend discharge opening of the compressor, so as to support the end of the compressor which houses the airend discharge opening of the compressor. In one aspect of the present invention, a drivetrain for operating the compressor is provided with a mounting foot and the separator tank is provided with an integrally cast mounting foot. The integrally cast member of the separator tank that supports the end of the compressor which houses the airend discharge opening of the compressor provides a third mounting foot. Because the compressor and the separator tank are directly attached to one another and the motor is directly secured to the compressor, the entire compressor system can be moved as a single unit. The mounting feet are conveniently attached to a support base in a chosen location.

The present invention provides in another aspect thereof, a cast separator tank having an integrally cast channel which is in fluid flow communication with a lower portion of a separation chamber and which extends along an outer surface of the separator tank. Oil separated from an air/oil mixture introduced into the separation chamber collects in the lower portion of the separation chamber. Pressure within the separation chamber causes the oil to flow into the channel and out of the separation chamber. Because the channel is integrally cast with the separator tank, there is no need for a hose and fitting device to enable the oil to flow out of the lower portion of the separation chamber.

In another embodiment, a cast separator tank includes an integrally cast lip which extends circumferentially around an inner wall of a separation chamber between an upper and a lower portion of the separator chamber. The integrally cast lip inhibits oil in an air/oil mixture introduced into the separation chamber from migrating up into the upper portion of the separation chamber when the air/oil mixture is directed around an inner wall of the separation chamber and subjected to centrifugal forces. Because the lip is integrally cast with the tank, the use of a baffle element is not required.

Other features and advantages of the invention will become apparent to those skilled in the art upon review of the following detailed description, claims and drawings in which like numerals are used to designate like features.

Figure 1:
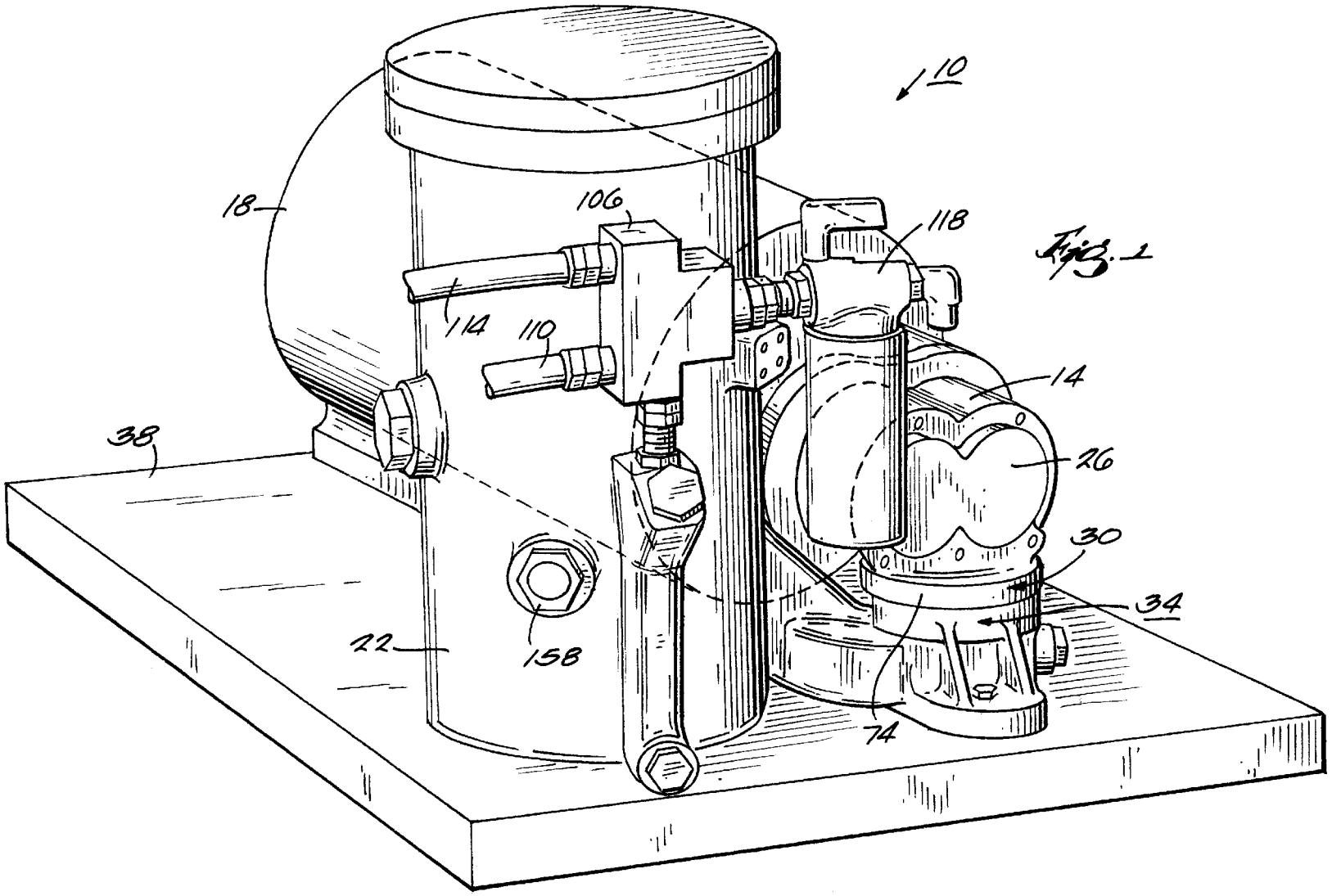
FIG. 1 is a perspective view of an air compressor system embodying the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

DETAILED DESCRIPTION OF THE PREFERRED EMBODIMENT

Illustrated in FIG. 1 is an air compressor system 10 embodying the present invention. It should be understood that the present invention is capable of use in other compressor systems and the air compressor system 10 is merely shown and described as an example of one such system.

The air compressor system 10 illustrated in FIG. 1 includes a compressor 14, a motor or drivetrain 18, and a separator tank 22. A feature of the present invention is that the separator tank 22 is a cast separator tank, rather than a fabricated steel tank as is the case for many conventional separator tanks. The compressor 14 is an oil-flooded, rotary screw air compressor. Air enters the compressor 14 and is compressed by rotary screws (not shown) found within housing 26. Oil is injected into the compressor 14 to lubricate the rotary screws and a gearbox (not shown) which drives the rotary screws. The oil further serves as a sealing means for the compressor 14. The compressed air and some of the oil travel out of the rotary screws through an airend discharge opening 30 and into an airend inlet opening 34 in the cast separator tank 22. The cast separator tank 22 serves to separate oil from the compressed air and also serves as an oil sump for the oil used to lubricate the rotary screws, the gearbox and other components. The compressed air and oil enter the cast separator tank 22 and are caused to undergo a cyclonic motion within the cast separator tank 22. As the compressed air and oil are flung around an inner surface the cast separator tank 22, the oil will slide down the inner wall and collect at the bottom of the cast separator tank 22 which acts as the oil sump for the compressor system 10, and the air will move up and out of the cast separator tank 22 for further filtering, cooling and ultimate use.

Figure 2:
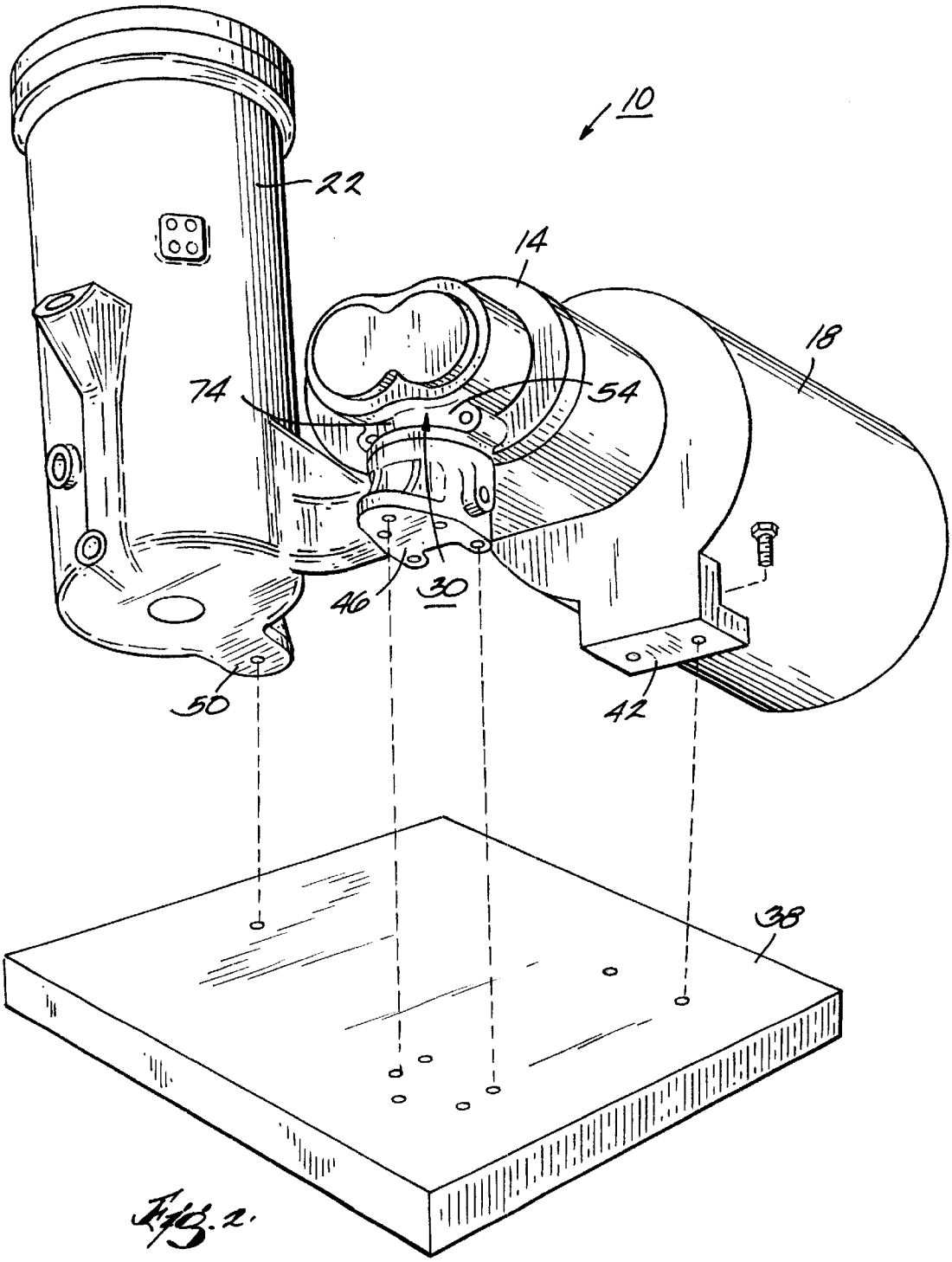
FIG. 2 is a partial exploded perspective view of the compressor system of FIG. 1.
Figure 4:
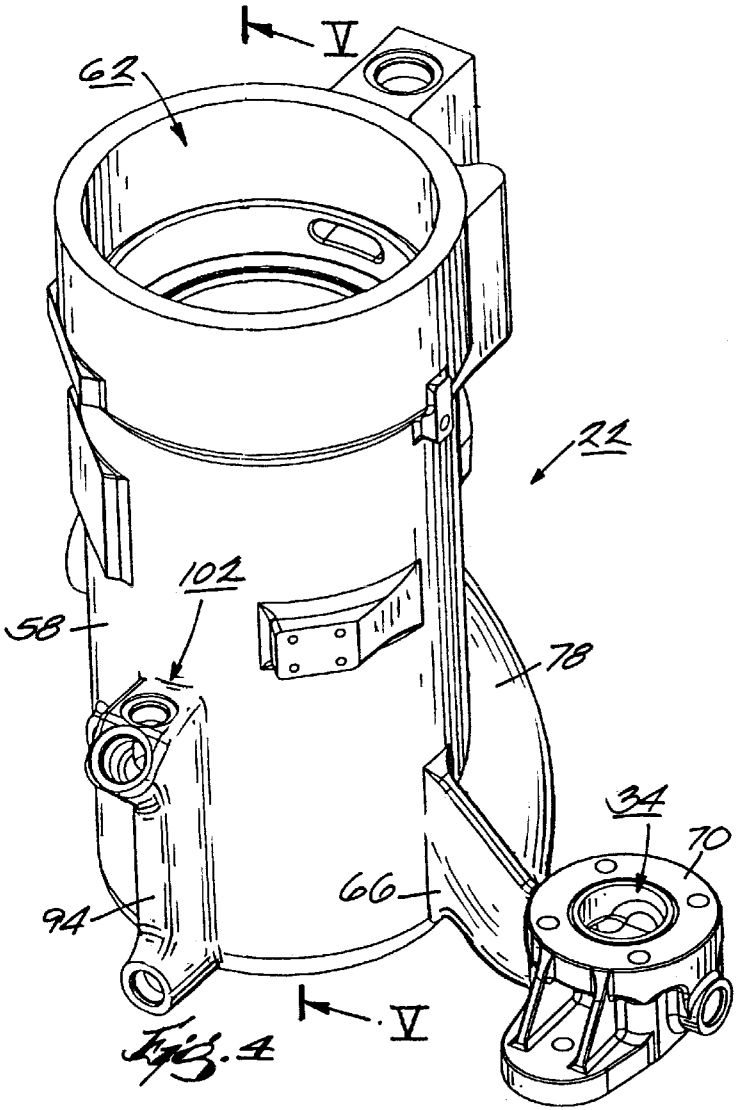
FIG. 4 is another side perspective view of the cast separator tank of FIG. 1.

As representatively shown in FIG. 1, the air compressor system 10 is mounted on a support frame or subbase 38. With reference to FIG. 2, the motor 18 is secured to the compressor 14. The motor 18 includes a mounting foot 42. The cast separator tank 22 includes an integrally cast mounting foot 46. The cast separator tank 22 further includes another integrally cast mounting foot 50. As will be further explained below, the integrally cast mounting foot 46 is also configured to support the end 54 (i.e., the airend) of the compressor 14 that houses the airend discharge opening 30 of the compressor 14, such that the compressor 14 and the cast separator tank 22 are securely attached to one another. As assembled in FIG. 2, the entire air compressor system 10 can be conveniently handled as a single unit. The air compressor system 10 is secured to the support frame 38 via mounting feet 42, 46 and 50 and associated hardware. Preferably, the mounting feet 42, 46 and 50 are arranged to provide a triangular support base.

FIGS. 3–7 illustrate in greater detail the cast separator tank 22. The cast separator tank 22 includes a side wall 58 and defines a separation chamber 62. The cast separator tank 22 further includes an airend inlet opening 34 (FIGS. 4, 6 and 7) which is positionable in direct or abutting relationship with the airend discharge opening 30 of the compressor 14 (see FIGS. 1 and 2). The compressed air and oil flowing out of the airend discharge opening 30 of the compressor 14 flows directly into the airend inlet opening 34 of the cast separator tank 22. Preferably, the cast separator tank 22 includes an integrally cast member 66 (FIGS. 4, 6 and 7) which extends outwardly from the side wall 58 of the cast separator tank 22. The integrally cast member 66 includes a mounting pad 70 which surrounds the airend inlet opening 34 of the cast separator tank 22. The airend inlet opening 34 of the cast separator tank 22 is positioned beneath the airend discharge opening 30 of the compressor 14 (see FIGS. 1–2). The mounting pad 70 is secured in face-to-face relationship with an associated pad 74 (see FIGS. 1–2) surrounding the airend discharge opening 30 of the compressor 14. Preferably, the integrally cast member 66 includes the integrally cast mounting foot 46 (see FIG. 2). Thus, the integrally cast member 66 supports the airend 54 of the compressor 14.

The cast separator tank 22 further includes an integrally cast channel 78 (FIGS. 3–4, and 6–7) extending between the airend inlet opening 34 and the separation chamber 62. The integrally cast channel 78 extends around a portion of the cast separator tank 22. Arrow 82 (FIGS. 6 and 7) best illustrates the flow path for the compressed air and oil from the airend inlet opening 34 through the channel 78 and into the separation chamber 62. The outlet 86 (FIG. 7) of the channel 78 that opens into the separation chamber 62 is arranged to tangentially introduce the air/oil mixture against an inner wall 90 of the separation chamber 62. Moreover, to enhance the separation process of the air/oil mixture, the outlet 86 of the channel 78 is also arranged to provide cyclonic motion to the air/oil mixture when the air/oil mixture enters and flows around the separation chamber 62.

The cast separator tank 22 also includes an integrally cast channel 94 (FIGS. 4–5) extending along an outer portion of the side wall 58 of the cast separator tank 22. The channel 94 is in fluid flow communication with a lower portion 98 (FIG. 5) of the separation chamber 62, so that as oil separates from the air/oil mixture introduced into the separation chamber 62 and collects in the lower portion 98, pressure within the separation chamber 62 will force the oil to flow into and up the channel 94 and out of an exit port 102 (FIGS. 4–5) provided in the channel 94. A thermal valve 106 (see FIG. 1 and partially shown in FIG. 5) is received by the exit port 102. The thermal valve 106 monitors the temperature of the oil. If the oil is too hot, at least a portion of the oil will flow through hose 110 (see FIG. 1) to a cooler (not shown) and back to the thermal valve 106 via hose 114 (see FIG. 1). Downstream of the thermal valve 106 is an oil filter device 118 (see FIG. 1) which filters the oil prior to it being fed to the compressor 14 to lubricate the rotary screws, the gearbox and other components.

The channel 94 preferably includes a first portion 122 (FIG. 5) which opens into the lower portion 98 of the separation chamber 62 and a second portion 126 (FIG. 5) which communicates with the first portion 122. The second portion 126 is preferably substantially parallel with the side wall 58 of the cast separator tank 22. The channel 94 also includes an oil fill port 130 (FIG. 5) for pouring oil into the separation chamber 62 and an oil drain port 134 (FIG. 5) for draining oil from the separation chamber 62. Each port 130, 134 is preferably threaded to receive a respective complementary plug 138, 142 (FIG. 5) when it is desired to close the ports 130, 134. Oil is introduced through the oil fill port 130 to provide an initial charge of lubricant for the air compressor system 10 and to top off or replenish any oil which is used or burned off during operation of the air compressor system 10.

Figure 5:
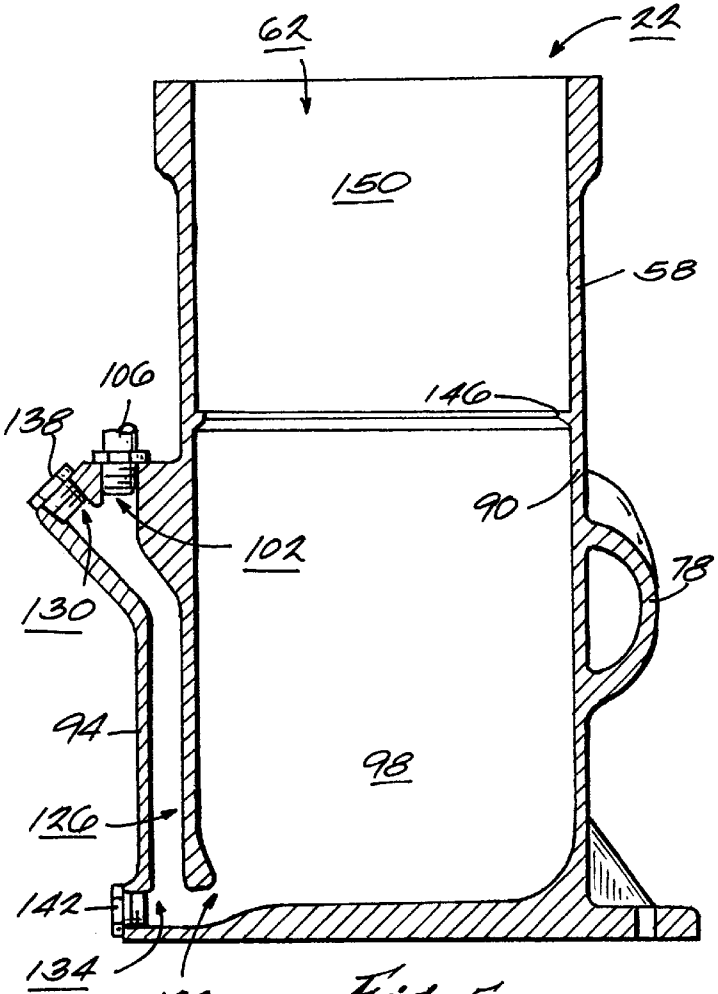
FIG. 5 is a cross-sectional view taken along line V—V of FIG. 4.
Figure 7:
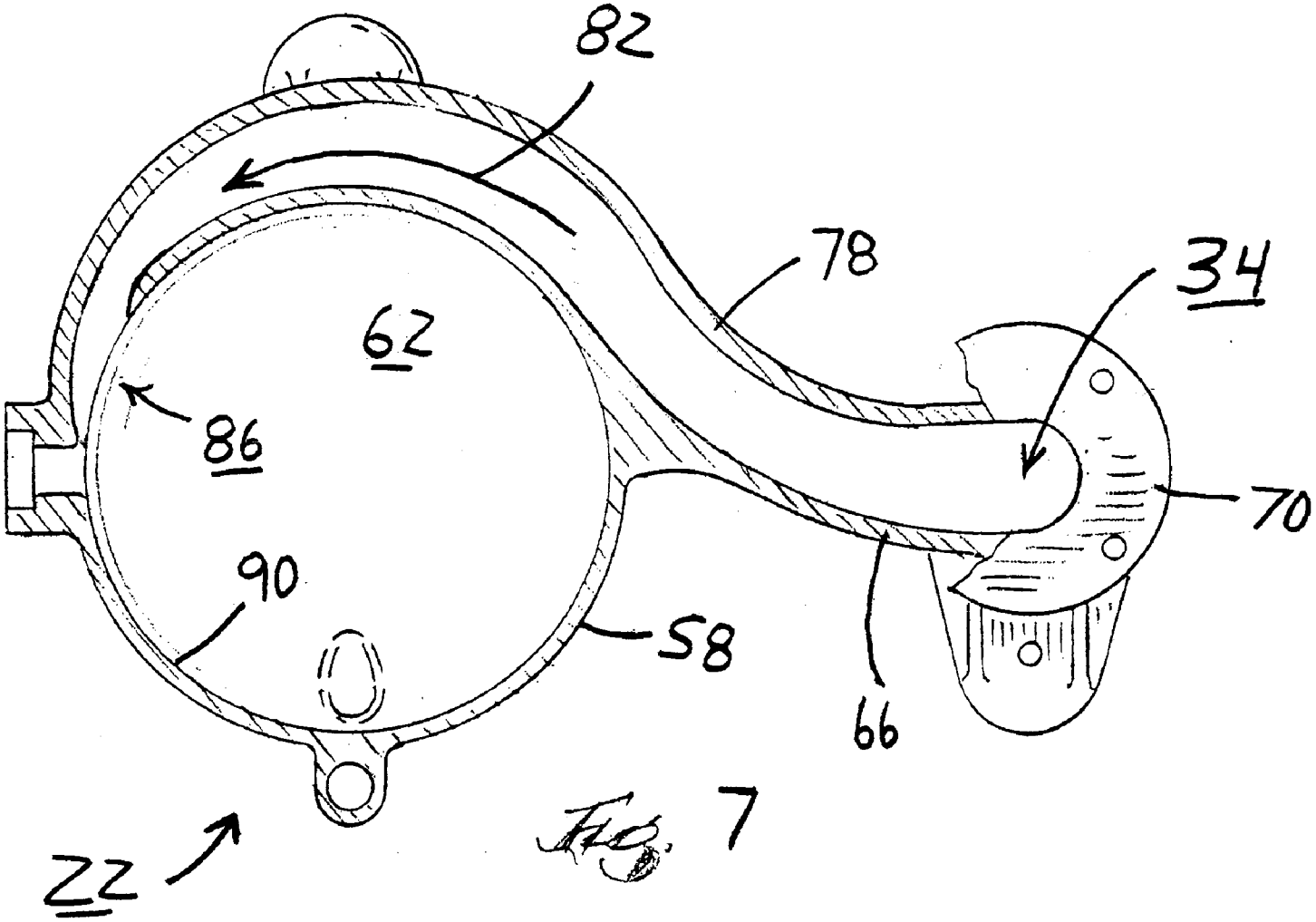
FIG. 7 is cross-sectional view taken along line VII—VII of FIG. 6.

The cast separator tank 22 includes an integrally cast lip 146 (FIG. 5) which extends circumferentially around the inner wall 90 of the separation chamber 62 between an upper portion 150 and the lower portion 98 of the separation chamber 62. The integrally cast lip 146 inhibits the oil in the air/oil mixture from migrating up into the upper portion 150 along the inner wall 90 when the air/oil mixture is directed around the inner wall 90 and subjected to centrifugal forces. As shown in FIG. 5, the air/oil mixture will flow into the separation chamber 62 via channel 78 below the lip 146. Although not clearly shown, because of the very nature of a cast piece, the inner wall 90 of the separation chamber 62 is provided with a non-smooth surface to further enhance separation of the oil from the air/oil mixture. Although not shown, the lip 146 may also be a support structure for various separating devices which may be utilized within the upper portion 150 of the separation chamber 62.

Figure 3:
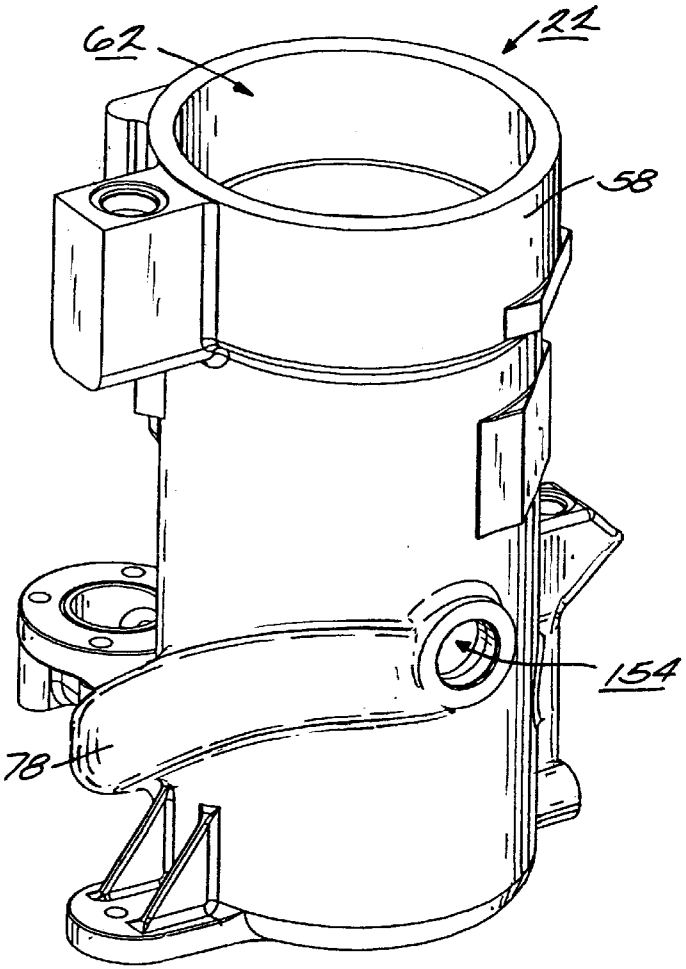
FIG. 3 is a side perspective view of the cast separator tank of FIG. 1.
Figure 6:
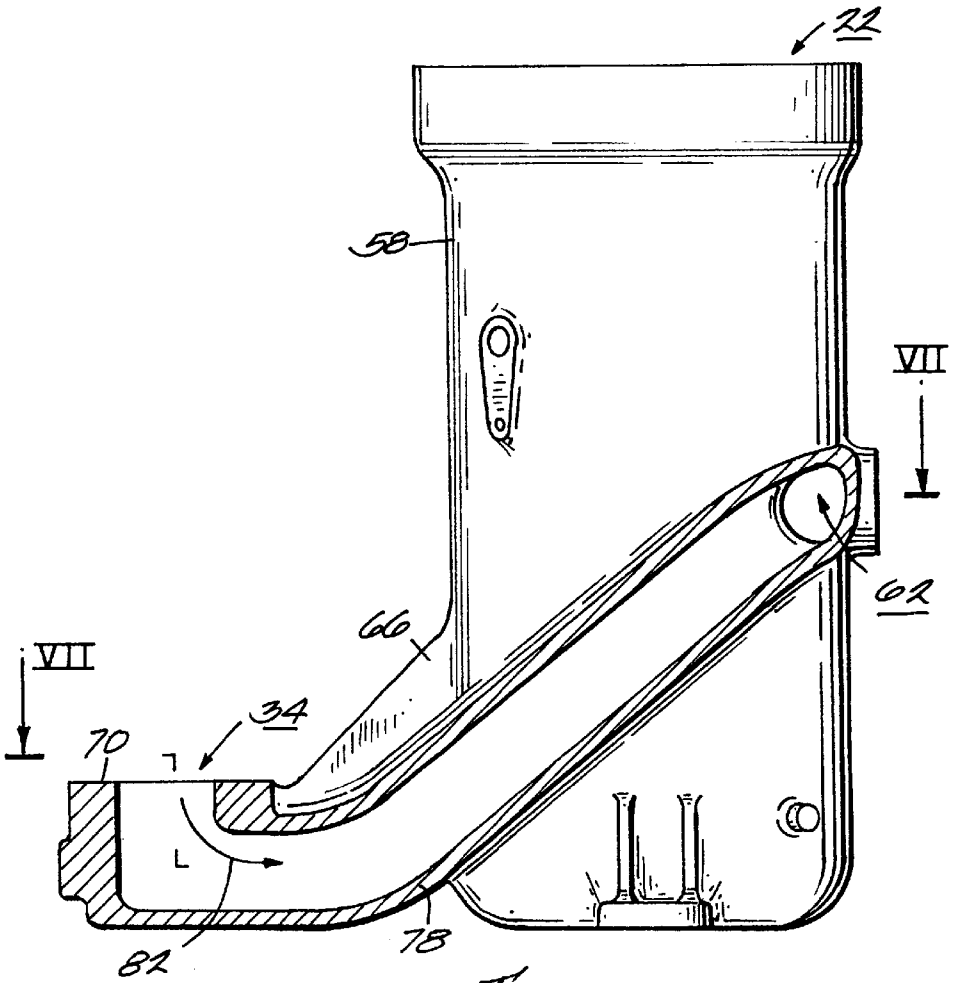
FIG. 6 is a partial cut-away view of the cast separator tank of FIG. 1.

It should be noted that the hole 154 shown in FIG. 3 in the side wall 58 of the cast separator tank 22 does not communicate with the channel 78. The hole 154 is provided to allow for the casting of the separator tank 22 and is plugged (see FIG. 1) upon final assembly of the air compressor system 10. It should also be noted that the plug 158 (see FIG. 1) extending through the side wall 58 of the cast separator tank 22 is an oil sight glass for the separation chamber 62.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A compressor system comprising:

an oil-flooded air compressor having an airend discharge opening;

a motor operatively connected to said compressor, said motor including a first mounting foot; and a cast separator tank having an airend inlet opening which is positioned in face-to-face, abutting relationship with said airend discharge opening of said compressor, said cast separator tank including an integrally cast second mounting foot, such that said first mounting foot of said motor and said second mounting foot of said cast separator tank support said compressor system during operation.

2. A compressor system according to claim 1, wherein said cast separator tank further includes an integrally cast member extending outwardly from a side wall of said cast separator tank, said cast member surrounding said airend inlet opening of said cast separator tank, such that said airend inlet opening of said cast separator tank is positioned below said airend discharge opening of said compressor and said cast member is fixedly secured to an associated surface surrounding said airend discharge opening of said compressor, wherein said second mounting foot of said cast separator tank forms a portion of said cast member so as to support an end of said compressor that houses said airend discharge opening of said compressor.

3. A compressor system according to claim 2, wherein said cast separator tank further includes an integrally cast third mounting foot for further supporting said compressor system during operation.

4. A compressor system according to claim 3, wherein the mounting feet are positioned to form a triangular arrangement with respect to each other.

5. A compressor system comprising:

an oil-flooded, rotary screw air compressor having an airend discharge opening; and a cast separator tank having a side wall and defining a separation chamber, said cast separator tank including an airend inlet opening positioned in direct relationship with said airend discharge opening of said compressor, such that an air/oil mixture flowing out of said airend discharge opening of said compressor flows into said airend inlet opening of said cast separator tank wherein said cast separator tank further includes an integrally cast member extending outwardly from said side wall of said cast separator tank and through which said airend inlet opening of said cast separator tank extends, said cast member supporting an end of said compressor that houses said airend discharge opening of said compressor.

6. A compressor system comprising:

an oil-flooded, rotary screw air compressor having an airend discharge opening; and a cast separator tank having a side wall and defining a separation chamber, said cast separator tank including an airend inlet opening positioned in direct relationship with said airend discharge opening of said compressor, such that an air/oil mixture flowing out of said airend discharge opening of said compressor flows into said airend inlet opening of said cast separator tank wherein said cast separator tank further includes an integrally cast member extending outwardly from said side wall of said cast separator tank, said cast member including a mounting pad which surrounds said airend inlet opening of said cast separator tank, such that said airend inlet opening of said cast separator tank is positioned below said airend discharge opening of said compressor, and said mounting pad is fixedly secured to an associated pad surrounding said airend discharge opening of said compressor.

7. A compressor system according to claim 5, wherein said cast separator tank further includes an integrally cast support flange extending outwardly from said side wall of said cast separator tank, said cast flange supporting said cast separator tank during operation.

* * * * *